United States Patent [19]

Bauer

[11] 4,418,914

[45] Dec. 6, 1983

[54] TOY PUZZLE ARRANGEMENT

[76] Inventor: Peter Bauer, 13921 Esworthy Rd., Germantown, Md. 20874

[21] Appl. No.: 338,722

[22] Filed: Jan. 11, 1982

[51] Int. Cl.[3] ..... A63F 9/08

[52] U.S. Cl. ..... 273/153 S; 273/155

[58] Field of Search ..... 273/153 R, 153 S, 155, 273/281; 434/174

[56] References Cited

U.S. PATENT DOCUMENTS

| | | | |
|---|---|---|---|
| 332,211 | 12/1885 | Protheroe | 273/153 S |
| 874,726 | 12/1907 | Barnes | 273/153 S X |
| 1,377,039 | 5/1921 | Wells | 273/153 S |
| 1,920,291 | 8/1933 | Burger | 273/153 S |
| 2,948,535 | 8/1960 | Ellman | 273/153 S X |
| 2,979,834 | 4/1961 | Giles | 434/174 |
| 3,081,089 | 3/1963 | Gustafson | 273/153 S X |
| 3,946,514 | 3/1976 | Joslyn | 273/153 S X |

FOREIGN PATENT DOCUMENTS

| | | | |
|---|---|---|---|
| WO81/01638 | 6/1981 | PCT Int'l Appl. | 273/153 S |

*Primary Examiner*—Anton O. Oechsle

*Attorney, Agent, or Firm*—Griffin, Branigan & Butler

[57] ABSTRACT

The present invention is a puzzle game which employs a plurality of moveable members, each of which bears at least one indicium, slideably mounted over rail-like means formed on a sectionalized base. One section of the base is the display section whereto the moveable members are moved in order to form a sought after display of the indicia which represents a solution of the puzzle. Another section of the base is the maneuvering section which is employed by the person solving the puzzle to change direction, location or orientation of the moveable members in an effort to find the solution to the puzzle. The maneuvering section includes a turntable means which enables the movable members to be moved from one rail to another and which enables the orientation of the indicia to be changed. In addition the moveable members can be readily removed or added to the puzzle to effect flexibility in the degree of difficulty offered in solving the puzzle.

11 Claims, 17 Drawing Figures

TOY PUZZLE ARRANGEMENT

BACKGROUND

Puzzles of all kinds including jig-saw puzzles, cross-word puzzles, chain link puzzles, etc. have offered hours of amusement to people, worldwide, for ages. Recently the world has been swept by a puzzle identified as Rubik's Cube and many variations thereof. These puzzles too have provided a great deal of pleasure but after the solution to such a puzzle becomes familiar the puzzle becomes stale. In the Rubik Cube type puzzle (and numerous variations thereof) the moveable members, i.e. the blocks, solid triangles, etc., are not moveable per se but must be moved as a group in different planes. In some variations the moveable members can be moved per se to a void, or empty space, but this can only be done by initially moving a group of moveable members lying in a plane. While from one point of view the foregoing limitations may add to the difficulty of solving the puzzle, nonetheless those limitations cause the solution to become a fixed routine and hence the puzzle loses its challenge after a given time.

The present inventive puzzle is designed to be flexible in that it can be many puzzles in one and flexible in that its solution can be accomplished in more than one way. The present puzzle permits the moveable members to be moved individually in first and second directions and individually, or as a group, in a third direction without any fixed number of moveable members having to be so moved in any one step to accomplish the solution. The present puzzle includes a turntable means which in one embodiment permits a moveable member to be moved with one surface (one indicium) remaining in the same plane while another surface of the member is moved to another plane which lies parallel to the plane from whence it was moved. The combination of these movements enables more than one solution to the present puzzle. In addition the moveable members can be readily removed, replaced or added so that solutions to the puzzle can vary to include maneuvering all member surfaces of the same color into a given plane and to include maneuvering the indicia on the member surfaces to form a picture as with a jig-saw puzzle.

SUMMARY

The present puzzle, in the preferred embodiment includes a first section whereto moveable pieces are moved to have indicia on such moveable pieces form a desired pattern (i.e. a solution to the puzzle). A second section is coupled to the first section so that (in one embodiment) it can be rotated in a plane orthogonal to the direction of movement of the moveable pieces. Both sections have rails formed thereon and upon which the moveable pieces are slideably mounted to permit the moveable pieces to be moved from one section to the other section and back. The second section is formed in abutment with a turntable means which permits a moveable member or moveable piece to have its pattern orientation changed and to be moved from one of said rails to another. As mentioned above the moveable members can be readily lifted from the rails, replaced or others can be added to change the nature or complexity of a solution to the puzzle.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
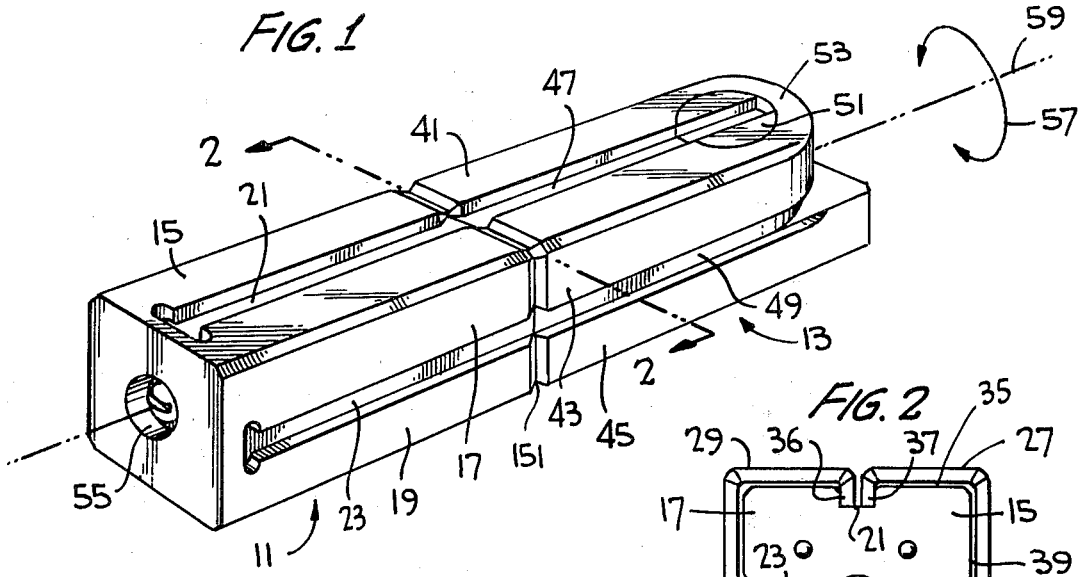
FIG. 1 is an isometric view of the square cross-section embodiment without mounted moveable members.
Figure 2:
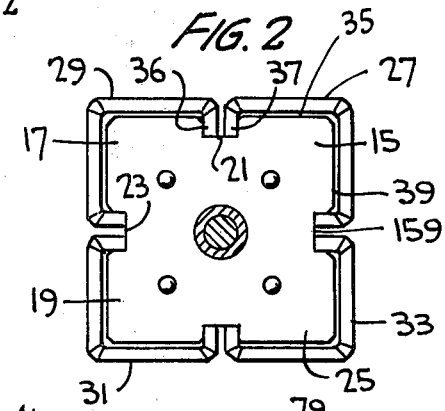
FIG. 2 is a cross-section view along 2—2 of the embodiment of FIG. 1 with some moveable members shown mounted.
Figure 3:
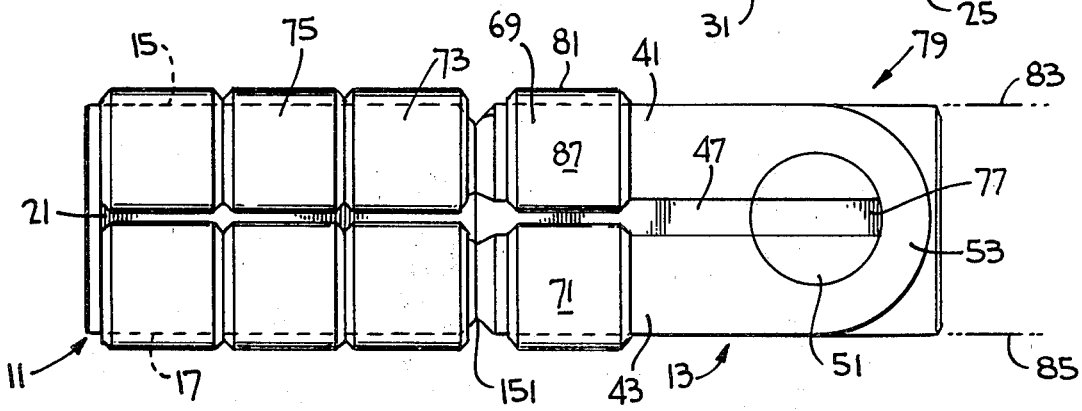
FIG. 3 is a plan view of the embodiment of FIG. 1 with a number of moveable members shown mounted.

Examine FIGS. 1, 2 and 3. FIG. 1 depicts a display member or base member 11 and a maneuvering member or positioning member 13 shown coupled together but without any moveable members mounted thereon. From FIG. 1 it can be gleaned that the base member 11, or display section, has at least three rail-like means 15, 17 and 19 formed integrally with the base member and formed to protrude therefrom. It should be understood that such rails could be formed separately and secured to the base member. As can also be seen in FIG. 1, there are base grooves 21 and 23 respectively formed between adjacent rail-like means 15 and 17 as well as between rail-like members 17 and 19. FIG. 2 shows a cross-section of the base member 11 along 2—2 depicting a fourth rail 25, not shown in FIG. 1, and with four moveable members, or moveable blocks, 27, 29, 31 and 33 slideably mounted on said rail-like means. Note that the base grooves, such as base groove 21, are each wide enough to permit two guide sections of moveable blocks, such as guide sections 36 and 37, to pass one another when the moveable blocks are moved. The base member 11, in the preferred embodiment, is fabricated from acrylic plastic, but could be fabricated from other rigid material. In the preferred embodiment, the moveable members, such as members 27, 29, 31 and 33 are also fabricated from acrylic plastic, but could be fabricated from other rigid materials which have the necessary resiliency to spring load the moveable member onto its associated rail, which requirement is related to the feature of removing, replacing or adding moveable members.

For instance, moveable member 27 can be removed from rail-like means 15 by inserting a screw-driver edge, or other tool, between the mating surfaces of moveable member 27 and rail 15 at location 35. The guide section 37 will be lifted to rest on the rail at location 35. If thereafter the screw-driver edge is inserted at location 39, the moveable member 27 will ¢spring" off the rail 15. Since the moveable members are inherently resilient, when mounted on a rail they spring load themselves partially around the rail.

FIG. 1 also depicts a positioning section 13 with rail-like means 41, 43 and 45 formed therewith and grooves 47 and 49 formed therebetween. Further located in abutment with the positioning section is a turntable means comprising a rotary member 51 and a wrap-around rail 53. The positioning member 13 is coupled to the base member 11 by virtue of a spring loaded screw located through the aperture 55 and pinned to the positioning section 13. The coupling arrangement can be better appreciated by considering FIG. 5.

Figure 5:
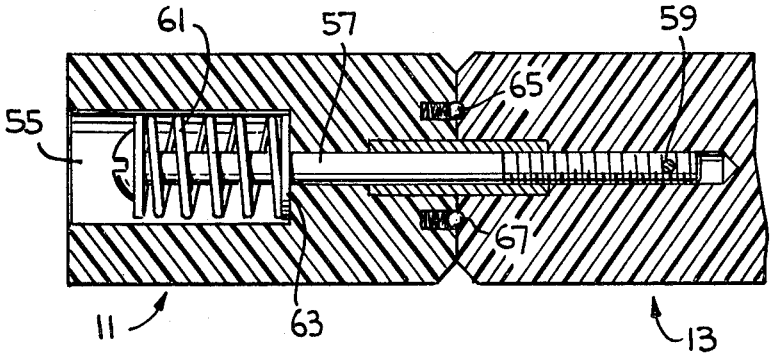
FIG. 5 is a sectional view along the longitudinal axis of the base showing a means for coupling the maneuvering section to the display section.

Note in FIG. 5 that there is a screw 57 which passes through sections 11 and 13. The screw 57 is pinned by pin 59 to section 13. The screw 57 is spring loaded by spring 61 against wall 63. In addition the positioning section 13 is detented by the spring loaded detents 65 and 67. Hence when the positioning section 13 is rotated around the screw 57, the screw 57 turns and the positioning section 13 cams the spring loaded detents into the base surface. The spring 61 forces the positioning section toward the base member 11 and when the detents, such as detents 65 and 67 (in the FIG. 1 embodiment there are four such detents) lie opposite or "see" matching recesses, the positioning member will "snap" into place. Every 90° of rotation will cause the two sections 11 and 13 to "snap" into place. It should be understood that a spring loaded bolt or rivet could be used in place of the screw 57. It should also be understood that the detents 65 and 67 need not be spring loaded or in an alternative mode the detents can be loaded and the bolt, screw or the like not spring loaded.

In FIG. 3 there is shown a plan view of the puzzle with similar identification members shown as were discussed in connection with FIGS. 1, 2 and 5. FIG. 3 enables the reader to understand to a great extent how the puzzle is operated. If for instance the person solving the puzzle wants to move, or maneuver, the moveable members 69 and 71 onto rail 15 in place of moveable members 73 and 75, the person could move member 69 to the right until its guide section is located in the groove 77 of rotary member 51. The moveable member 69 is then rotated 180° and moved onto rail 43, adjacent to moveable member 71. Thereafter blocks, or moveable members, 73 and 75 are moved onto rail 41. In the next step, the person rotates the positioning member 13 by 90°, (into the drawing sheet), so that rotary member 51 is in the position identified by arrow 79. At this point in time, rail 43 will lie opposite rail 15 and there will be two voids on rail 15. The person may now move the members 71 and 69 onto rail 15 which was what the person wanted to accomplish toward solving the puzzle.

It should be noted that when block 69 was transferred from rail 41 to rail 43, the surface 81 was moved from a plane identified by line 83 to a plane identified by line 85 and it should be further noted that the surface 87 has been reoriented by 180°. These last two mentioned changes along with the feature of readily adding or replacing moveable members enables the puzzle to be a number of puzzles in one. For instance instead of making the surfaces of the moveable members represent solid colors (so that the solution is to get one side of the display section all the same color) the blocks can carry portions of a composite design or a picture. The blocks can then be maneuvered to complete the design, or the picture, in a manner similar to completing a jig-saw puzzle.

The change of orientation described above is not only an assist to completing the picture but an inadvertent change of orientation serves to make completing the picture more difficult and challenging. The solution to the puzzle could be combinations of pictures and designs and hence the unique flexibility of the present puzzle becomes apparent.

Figure 4:
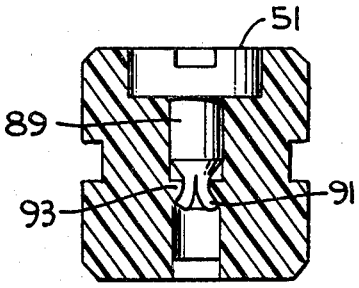
FIG. 4 is a sectional view of the turntable end of the base showing one embodiment of a mounted rotary member.

FIG. 4 depicts a means for mounting the rotary table in the turntable means. As can be gleaned from FIG. 4 the rotary table 51 is formed with a stud section 89 which is further formed with resilient prongs 91. The prongs 91 are formed to be cammed together as they pass through the throat 93 and formed to then spread apart when they reach the chamber below the throat. In this way the rotary member 51 is locked against vertical movement but is permitted to effect a rotational movement. There are other means and methods for securing the rotary member to permit rotation while preventing vertical movement.

Figure 6:
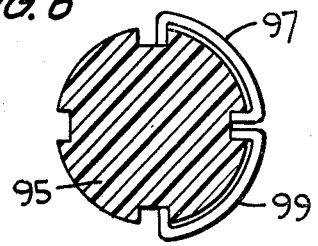
FIG. 6 is a sectional view of a base member which is substantially cylindrical and showing two moveable members mounted thereon.
Figure 7:
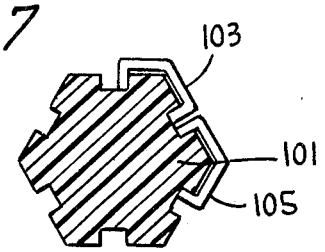
FIG. 7 is a sectional view of a base member which is substantially polygonal and showing two moveable members mounted thereon.

FIG. 6 depicts a base member 95 which is substantially cylindrical in shape and which has arcuately, shaped moveable members 97 and 99, slideably mounted thereon. FIG. 7 depicts a base member 101 which is polygonal in shape and which has moveable members 103 and 105 (which are substantially "V" shaped) mounted thereon. The base of the present invention may take on many shapes, (such as hexagonal), of which the bases 95 and 101 are but two and yet all of these configurations are within the scope of the present invention.

Figure 8:
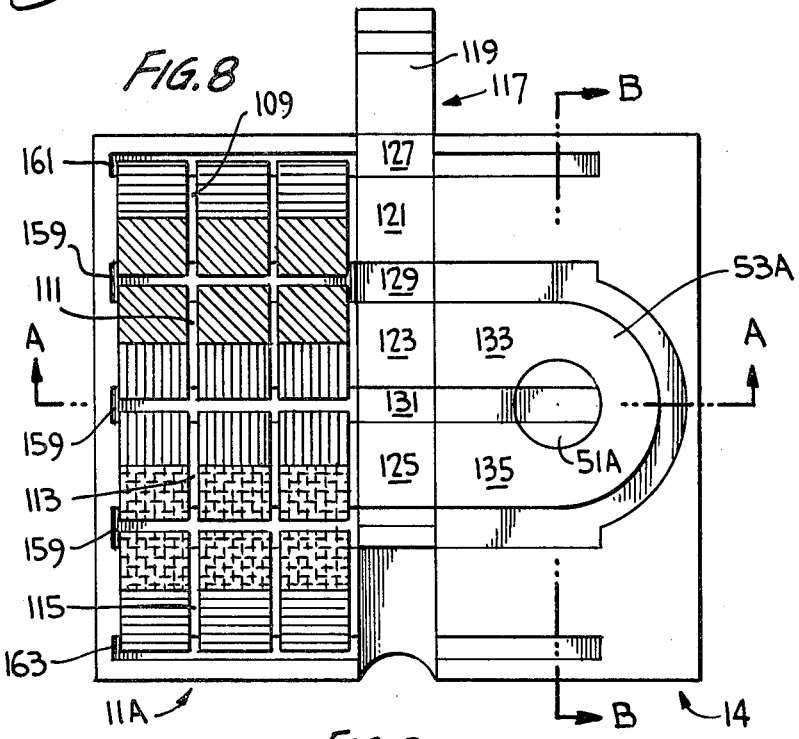
FIG. 8 is a plan view of a flat version embodiment of the present puzzle.
Figure 11:
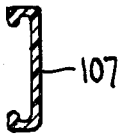
FIG. 11 is a sectional view of one of the moveable members used in the embodiment of FIG. 8.

FIG. 8 depicts a flat version of the present invention. In the embodiment of FIG. 8 the moveable members are formed as shown by member 107 of FIG. 11. The flat moveable members are slideably mounted on rails 109, 111, 113 and 115 of the displaying section 11A. The turntable means 14 has a rotary member 51A and a wrap around rail 53A. In between the base member, or display member, 11A and the turntable means 14, there is a sliding member 117 which acts in the role of the positioning member. The sliding member 117 has four rail sections 119, 121, 123 and 125 separated by grooves 127, 129 and 131. The moveable members can be moved onto the sliding member 117 and moved up or down (bidirectionally orthogonal to the rails 109, 111, 113 and 115). Accordingly moveable members can be loaded, for instance, onto rail 121 from rail 109 and moved opposite rail 133 of the turntable means 14. The moveable member than can be removed onto rail 133. Thereafter a moveable member can be moved from rail 111 onto rail section 123 and further onto rail 133 thus moving the first moveable means onto the rotary member 51A. The moveable member loaded onto rotary member 51A can be turned around the wrap around rail 53A to be located on rail 135. From rail 135 the moveable member can be moved from rail 135 to rail section 123 by moving the sliding member 117 down so that rail section 123 can receive the moveable member from rail 135. After the rail section 123 receives the moveable member the sliding member 117 can be moved upward to be opposite rail 111. Thereafter the moveable member on rail section 123 can be removed from rail section 123 onto rail 111. Hence the flat version can accomplish the three directional movement of the embodiment of FIG. 1.

Figure 10:
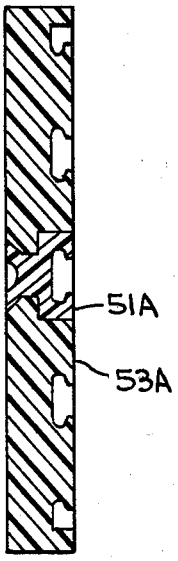
FIG. 10 is a sectional view through B—B of FIG. 8.
Figure 9:
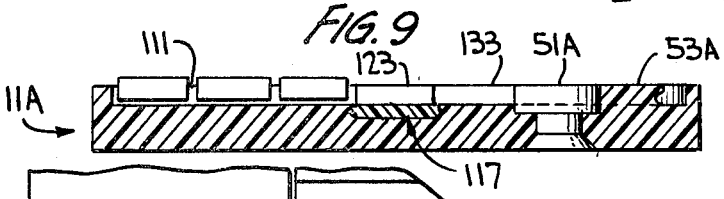
FIG. 9 is a sectional view through A—A of FIG. 8.

FIG. 9 depicts a cross-sectional view along line A—A and further aids in the understanding of the arrangement of the embodiment of FIG. 8. FIG. 10 depicts a cross-sectional view of the embodiment of FIG. 8 along the line B—B and further aids in the understanding of the embodiment of FIG. 8.

Figure 12:
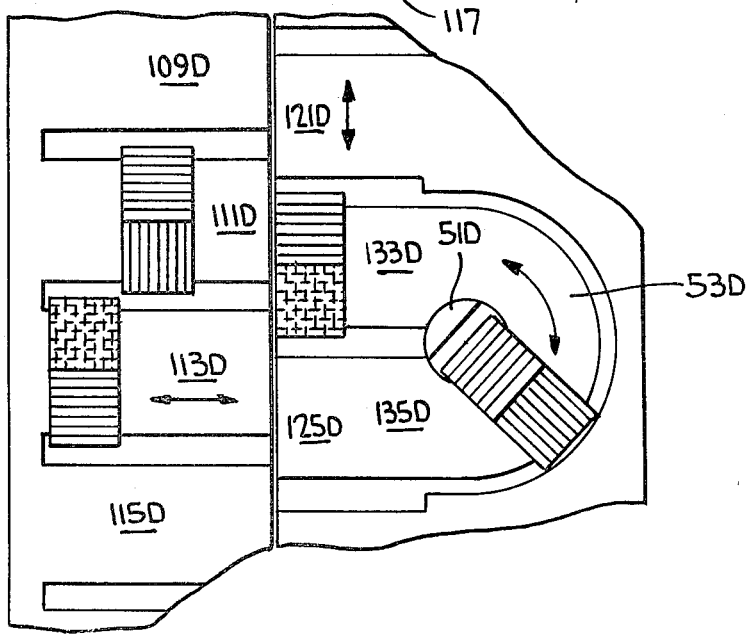
FIG. 12 is an enlarged pictorial schematic view showing the turntable end and possible movement of moveable members.

FIG. 12 depicts an embodiment wherein the turntable means moves with the positioning member. The identification numbers of FIG. 8 are used in FIG. 12 and no further explanation seems necessary.

Figure 14:
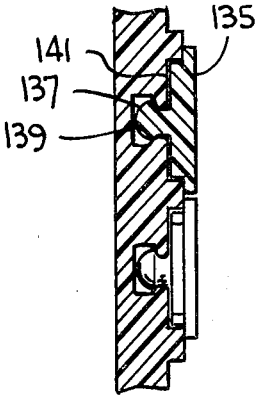
FIG. 14 is a sectional view along C—C showing the moveable members with studs.
Figure 13:
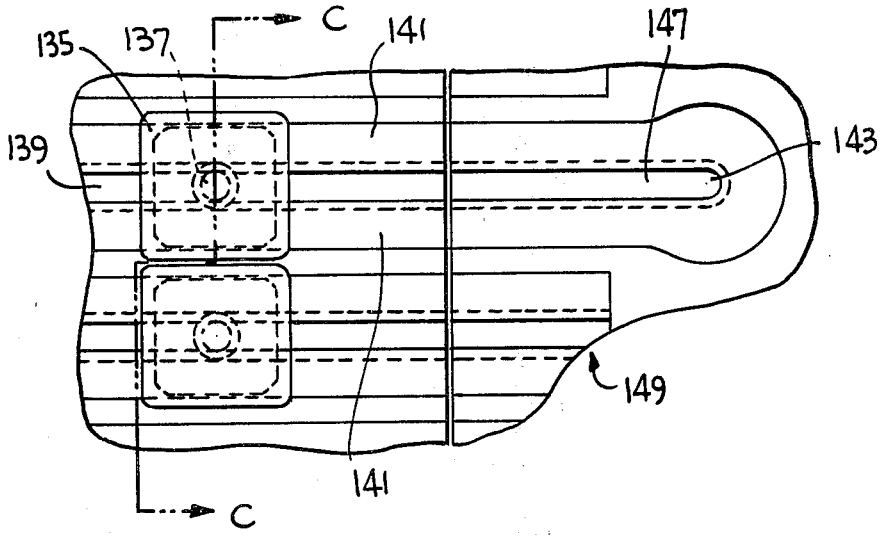
FIG. 13 is a plan view of a portion of the body including a turntable means which employs moveable members which include studs to hold them in their tracks.

FIG. 13 is another flat version of the puzzle which operates similarly to the embodiments previously described. In the embodiment of FIG. 13 the positioning section is integral with the turntable section, but it should be understood that the positioning section can be a separate sliding section as shown in FIG. 8. In FIG. 13 the turntable section moves with the positioning section and the combined sections are fabricated to slide as the sliding section 117 of FIG. 8. The moveable members employed with this version are best understood by considering FIG. 14. FIG. 14 is a view along line C—C of FIG. 13. In FIG. 14 it can be seen that the moveable members have studs with substantially spherical ends. The spherical ends lock the moveable members into their respective tracks against vertical movement out of the tracks but at the same time permit the moveable members to be moved along the tracks (i.e. in the grooves) while resting on the rail means. In FIG. 14 the moveable member 135 is held by the spherical shaped stud 137 in the track or groove 139 but can be moved into and out of the drawing sheet while resting on track 141. In this embodiment the turntable means does not require a rotary member. The moving member is moved into the turntable means until the spherical ended stud is located in the end 143 of groove 147. When the moveable member is so located the moveable member is spun to a new orientation and returned to the positioning section 149. The moveable members can be readily snapped out of the tracks and/or inserted therein. It should be noted that in this embodiment the moveable member can be rotated 90°, 180°, or 270° so that the pattern or indicium orientation can be changed by 90°, 180° or 270° to enhance the possibilities of puzzle solutions and difficulties in solutions.

Figure 15:
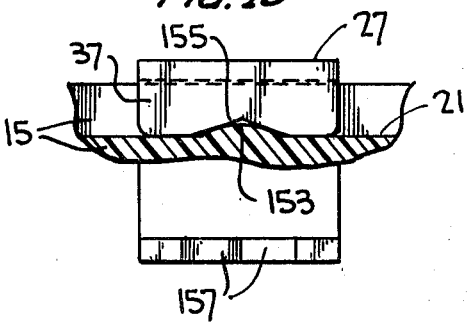
FIG. 15 is a partial cross-sectional view of a rail with a moveable member mounted thereon and depicting the means for restraining the moveable member in a preferred position.
Figure 16:
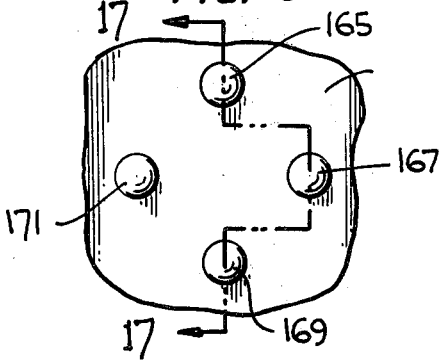
FIG. 16 shows an end view of a detent arrangement between the base member and the positioning member.
Figure 17:
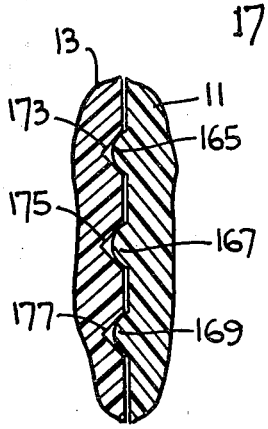
FIG. 17 shows a cross-sectional view along lines 17—17.

Thus far the description has dealt with the overall structure of the puzzle. The present invention includes features in its construction which enable it to be readily used. For instance in other puzzles all of the members which bear indicium must be carefully aligned or the puzzle gets jammed. In the present invention when the positioning member 13, shown in FIG. 1, is rotated orthogonally to the rails of the base member 11, the moveable members are restrained and do not spuriously move to bridge the separation 151 and thereby make the rotating action difficult or not feasible. The feature that is employed to accomplish the restraint is shown in FIG. 15. The identification numbers of FIG. 15 can be better understood by examining FIG. 2 simultaneously. In FIG. 15 the rail-like means 15 can be seen with the moveable member 27 mounted thereon. Along the surface of the groove 21, rail-like means 15 is formed to provide a protrusion 153. The protrusion 153 fits into a recess 155 of the moveable member 27. Accordingly when the moveable member 27 is located in its proper position and its recess 155 is fitting over the protrusion 153, it will be restrained from a spurious movement which might interfere with the rotational movement of positioning member 13 with respect to base member 11. The further restraining feature keeps each of the moveable members from spuriously bumping an adjacent moveable member and distorting the puzzle solution. The user, of course, can readily cam, or move, a moveable member over its associated protrusion to enable it to slide to a new location. In FIG. 15 there is also shown a second recess 157 which fits over a matching protrusion located along the groove 159 of FIG. 2. It should be noted that other forms of detents could be employed to effect the restraining action described above.

The construction of the sliding member 117 of FIGS. 8 and 9 should also be noted. The section of the base which holds the sliding member 117 has a double-sided above-tailed groove formed therein in which the sliding member 117 is freely slideable. When sliding member 117 is in its central position, rail-like means 119 and 125 lie respectively opposite rails 109 and 115. In the preferred embodiment, the grooves 159 are each double-sided and dove-tailed while the outside grooves, such as grooves 161 and 163 are undercut on the inner side only. It should be understood that other forms for slideably restraining the moveable members could be employed.

While the invention has been particularly shown and described with reference to the preferred embodiments thereof, it will be understood by those skilled in the art that various alterations in form and detail may be made therein without departing from the spirit and scope of the invention. For example, the above described puzzle permits a bidirectional movement of moveable members, a third directional movement of moveable members and a means to effect a reorientation of moveable members. In addition the moveable members can be readily removed or added. All of the foregoing features enable the present puzzle to be challenging, flexible and many puzzles in one.

The embodiments of the invention in which an exclusive property or privilege is claimed are defined as follows:

1. A toy puzzle arrangement comprising in combination: a base member having a plurality of non-planar faces, at least two of said faces having rail-like means as part thereof, said rail-like means bidirectionally oriented along first and second directions in the plane of said face wherein said rail-like means is included; a plurality of movable members each of which bears at least one indicium, said movable members formed and disposed to be slideably mounted on said rail-like means; turntable means formed to receive a movable member and enable it to be substantially rotated so that the indicium that it bears has its orientation changed; and positioning means formed and disposed to operate with said base member to receive a movable member and enable it to be moved in a third direction out of the plane of said face and further to enable it to be transferred to said turntable means and selectively returned to said base member in seeking a solution to said puzzle.

2. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means; said base member being formed to have base grooves between adjacent ones of said rail-like means and wherein each of said movable members is formed to have guide sections fitting into said base grooves which lie on opposite sides of a rail-like means upon which it is slideably mounted; turntable means formed to receive a movable member and enable it to be substantially rotated so that the indicium that it bears has its orientation changed; and positioning means formed and disposed to operate with said base member to receive a movable member and enable it to be moved in a third direction and further enable it to be transferred to said turntable means and selectively returned to said base member in seeking a solution to said puzzle.

3. A toy puzzle according to claim 2 said base grooves have selected protrusions formed thereon and wherein said movable members have recesses formed in their respective guide sections to fit said protrusions whereby each of said movable members can be restrained from spurious movement when its recess is fitting with one of said protrusions.

4. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means; turntable means formed to receive a movable member and enable it to be substantially rotated so that the indicium that it bears has its orientation changed, said turntable means having a rotary member with a groove formed therein, said turntable means further including a rail-like means disposed to wrap-around a portion of said rotary member and wherein said last mentioned rail-like means if further formed to terminate in first and second rail-like sections so that a movable member received by said turntable means can be received on said first rail-like section, moved onto said rotary member, substantially rotated and removed from said rotary member onto said second rail-like section; and, positioning means formed and disposed to operate with said base member to receive a movable member and enable it to be moved in a third direction and further to enable it to be transferred to said turntable means and selectively returned to said base member in seeking a solution to said puzzle.

5. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means, said base member being formed so that its cross section is substantially square shaped and said movable members being substantially "C" shaped; turntable means formed to receive a movable member and enable it to be substantially rotated so that the indicium that it bears has its orientation changed; and positioning means formed and disposed to operate with said base member to receive a movable member and enable it to be moved in a third direction and further to enable it to be transferred to said turntable means and selectively returned to said base member in seeking a solution to said puzzle.

6. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means, said base member being formed so that its cross section is substantially cylindrically shaped and said movable members being substantially arcuately shaped; turntable means formed to receive a movable member and enable it to be substantially rotated so that the indicium that it bears has its orientation changed; and positioning means formed and disposed to operate with said base member to receive a movable member and enable it to be moved in a third direction and further to enable it to be transferred to said turntable means and selectively returned to said base member in seeking a solution to said puzzle.

7. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means, said base member being formed so that its cross section is substantaily polygonal in shape and wherein said movable members being substantially "V" shaped; turntable means formed to receive a movable member and enable it to be substantially rotated so that the indicium that it bears has its orientation changed; and positioning means formed and disposed to operate with said base member to receive a movable member and enable it to be moved in a third direction and further to enable it to be transferred to said turntable means and selectively returned to said base member in seeking a solution to said puzzle.

8. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means; turntable means formed to receive a movable member and enable it to be substantially rotated so that the indicium that it bears has its orientation changed; and positioning means formed and disposed to operate with said base member to receive a movable member and enable it to be moved in a third direction and further enable it to be transferred to said turntable means and selectively returned to said base member in seeking a solution to said puzzle; said base member and said positioning member being coupled by coupling means whereby said positioning member can be rotated orthogonally to said first and second directions.

9. A toy puzzle according to claim 8, wherein said coupling means comprises spring-loaded means for coupling said base member and said positioning member.

10. A toy puzzle according to claim 8 wherein there is further included detent means disposed to secure said base member in particular locations with respect to said positioning member after completion of at least a partial rotation of said positioning member.

11. A toy puzzle arrangement comprising in combination: a base member formed to have a plurality of rail-like means as part thereof, said rail-like means bidirectionally oriented along first and second directions; a plurality of movable members each of which bears at least one indicium, said movable members formed and disposed to be slideably mounted on said rail-like means; turntable means formed to receive a movable member and enable it to be substantially rotated so that the indicium that it bears has its orientation changed; said turntable means include a rotary member, an arcuately shaped rail-like means disposed to partially wrap-around said rotary member, and formed to terminate in first and second rail-like sections, said first and second rail-like sections disposed to be aligned with adjacent rail-like means on said base member; positioning means formed and disposed to operate with said base member to receive a movable member and enable it to be transferred to said turntable means and selectively returned to said base member in seeking a solution to said puzzle; said positioning member including a slideable piece formed with rail-like sections which can be aligned with said rail-like means of said base member.

* * * * *